US011668439B2

(12) United States Patent
Liu et al.

(10) Patent No.: US 11,668,439 B2
(45) Date of Patent: Jun. 6, 2023

(54) LED LIGHT DISTRIBUTION STRUCTURE, LIGHT SOURCE MODULE AND LAMP

(71) Applicants: OPPLE LIGHTING CO., LTD., Shanghai (CN); SUZHOU OPPLE LIGHTING CO., LTD., Suzhou (CN)

(72) Inventors: Chaobo Liu, Suzhou (CN); Hongbo Wang, Suzhou (CN); Qingjun Wei, Suzhou (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 17/561,699

(22) Filed: Dec. 23, 2021

(65) Prior Publication Data

US 2022/0112989 A1 Apr. 14, 2022

Related U.S. Application Data

(63) Continuation of application No. PCT/CN2020/119239, filed on Sep. 30, 2020.

(30) Foreign Application Priority Data

Oct. 9, 2019 (CN) ..... 201910954428.2
Oct. 9, 2019 (CN) ..... 201921677858.6

(51) Int. Cl.
*F21K 9/232* (2016.01)
*F21K 9/238* (2016.01)
(Continued)

(52) U.S. Cl.
CPC ..... *F21K 9/232* (2016.08); *F21K 9/238* (2016.08); *F21V 5/04* (2013.01); *F21Y 2115/10* (2016.08)

(58) Field of Classification Search
CPC . F21K 9/232; F21K 9/238; F21V 5/04; F21V 5/00; F21V 5/046; F21Y 2115/10
See application file for complete search history.

(56) References Cited

U.S. PATENT DOCUMENTS 9,341,341 B1 * 5/2016 Wu ..... F21V 5/04
2014/0049951 A1 * 2/2014 Ariyoshi ..... F21L 4/00 362/208
2014/0343904 A1 11/2014 Chen

FOREIGN PATENT DOCUMENTS

CN 201133608 Y 10/2008
CN 104566205 A 4/2015
(Continued)

OTHER PUBLICATIONS

International Search Report of PCT Application No. PCT/CN2020/119239 dated Jan. 4, 2021 with English translation, (4p).

*Primary Examiner* — Bao Q Truong
(74) *Attorney, Agent, or Firm* — Arch & Lake LLP

(57) ABSTRACT

Examples of the present disclosure disclose an LED light distribution structure, a light source module and a lamp. The LED light distribution structure includes a ring-shaped light distribution element and a plurality of LED chips; the ring-shaped light distribution element is provided with a light source cavity in a ring shape, and the light source cavity has a ring center and a center line surrounding the ring center in a ring shape; the plurality of LED chips are arranged in a ring shape in the light source cavity, each of the LED chips includes an LED and a chip substrate, and the LED is on the chip substrate; and LEDs on all the LED chips are uniformly arranged along a ring-shaped wiring line, the ring-shaped wiring line is in a concentric ring with the center line, and the ring-shaped wiring line is located inside or outside of the center line.

20 Claims, 11 Drawing Sheets

(51) Int. Cl.
*F21V 5/04* (2006.01)
*F21Y 115/10* (2016.01)

(56) References Cited

FOREIGN PATENT DOCUMENTS

| | | | |
|---|---|---|---|
| CN | 110296375 | A | 10/2019 |
| CN | 210372914 | U | 4/2020 |

* cited by examiner

LED LIGHT DISTRIBUTION STRUCTURE, LIGHT SOURCE MODULE AND LAMP

CROSS-REFERENCE TO RELATED APPLICATIONS

This application is based upon and claims the priority of PCT patent application No. PCT/CN2020/119239 filed on Sep. 30, 2020 which claims priority to the Chinese patent application No. 201910954428.2 filed on Oct. 9, 2019 and the Chinese patent application No. 201921677858.6 filed on Oct. 9, 2019, the entire contents of which are hereby incorporated by reference herein for all purposes.

TECHNICAL FIELD

The present disclosure relates to a field of inductor manufacturing technologies, and more particularly, to an LED light distribution structure, a light source module and a lamp.

BACKGROUND

Lamps are one kind of lighting equipment indispensable in people's lives, and along with development of society, functions of lamps have gradually developed from a single indoor lighting to more functions such as decoration and rendering, which continuously enriches people's living environment.

SUMMARY

Examples of the present disclosure provides an LED light distribution structure and a light source module.

On the one hand, the examples of the present disclosure provide an LED light distribution structure. The LED light distribution structure may include a ring-shaped light distribution element and a plurality of LED chips. The ring-shaped light distribution element may be provided with a light source cavity in a ring shape, and the light source cavity may have a ring center and a center line surrounding the ring center in a ring shape. The plurality of LED chips may be arranged in a ring shape in the light source cavity, each of the LED chips may include an LED and a chip substrate, and the LED may be on the chip substrate; and LEDs on all the LED chips may be uniformly arranged along a ring-shaped wiring line, the ring-shaped wiring line may be in a concentric ring with the center line, and the ring-shaped wiring line may be located inside or outside of the center line.

On the second hand, the examples of the present disclosure provide a light source module. The light source module may include a light source board and an LED light distribution structure. The LED light distribution structure may include a ring-shaped light distribution element and a plurality of LED chips. The ring-shaped light distribution element may be provided with a light source cavity in a ring shape, and the light source cavity may have a ring center and a center line surrounding the ring center in a ring shape. The plurality of LED chips may be arranged in a ring shape in the light source cavity, each of the LED chips may include an LED and a chip substrate, and the LED may be on the chip substrate; and LEDs on all the LED chips may be uniformly arranged along a ring-shaped wiring line, the ring-shaped wiring line may be in a concentric ring with the center line, and the ring-shaped wiring line may be located inside or outside of the center line. The LED chips are arranged on the light source board, and the ring-shaped light distribution element covers on the light source board.

It is to be understood that both the foregoing general description and the following detailed description are exemplary and explanatory only and are not restrictive of the present disclosure.

BRIEF DESCRIPTION OF THE DRAWINGS

The drawings described here are used to provide a further understanding of the present disclosure and constitute a part of the present disclosure. The examples and descriptions of the present disclosure are used to explain the present disclosure, and do not constitute an improper limitation of the present disclosure. In the drawings.

DETAILED DESCRIPTION

Figure 1:
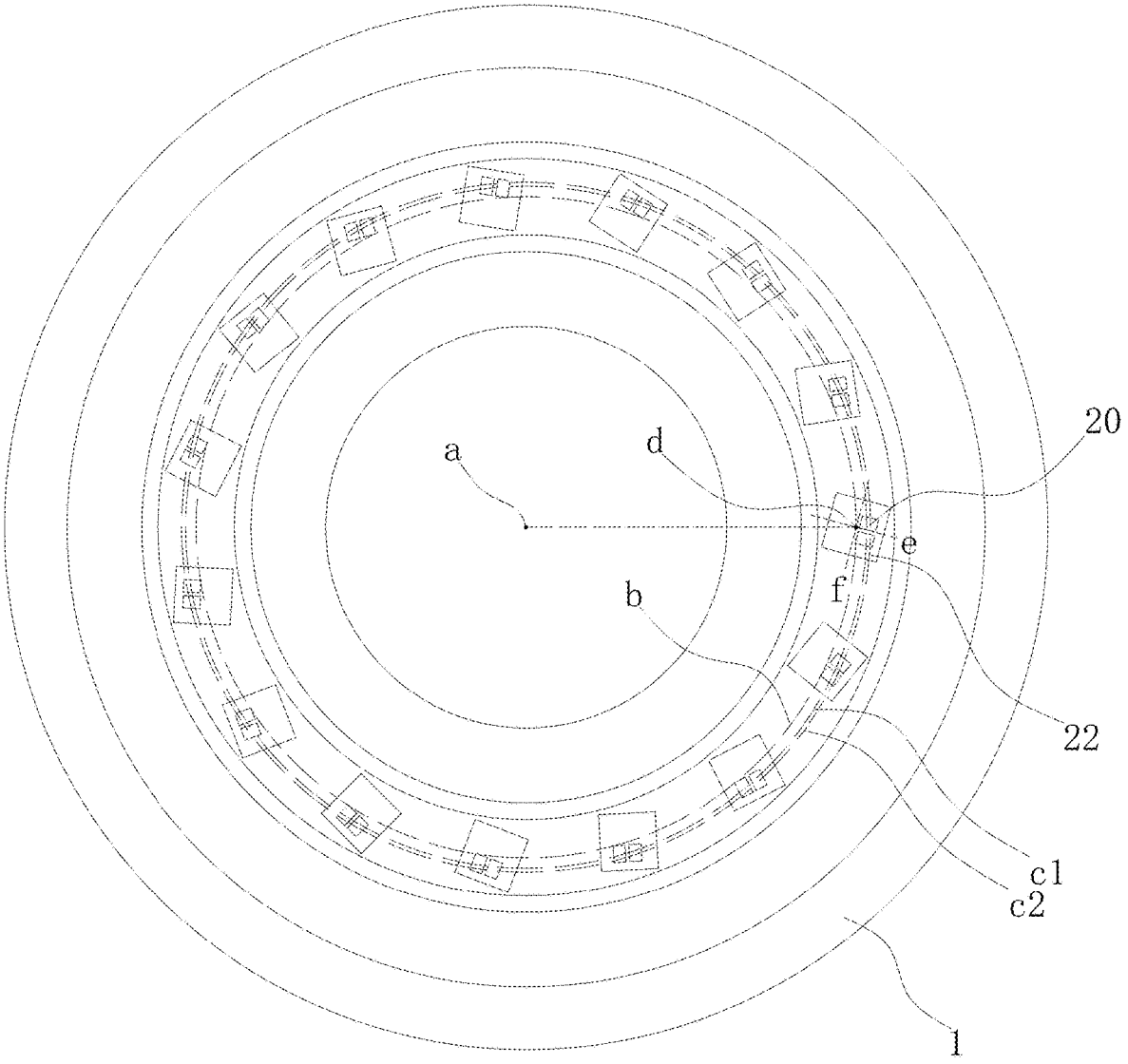
FIG. 1 is a top assembly view of an LED light distribution structure with a center d on the center line b and an LED chip rotating with the center d as an axis until ring-shaped wiring lines c1 and c2 are located outside the center line b according to an example of the present disclosure.
Figure 2:
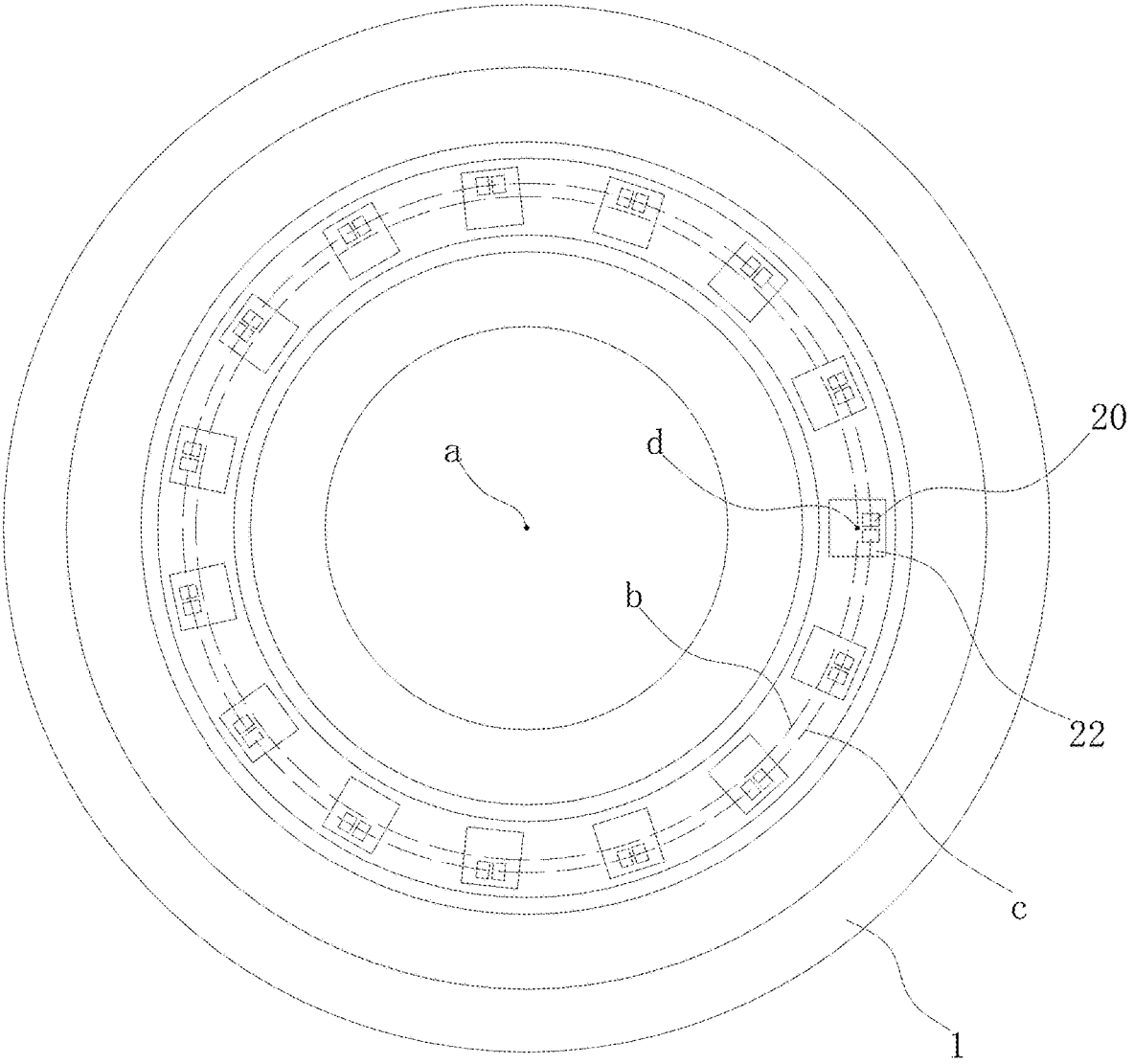
FIG. 2 is a top assembly view of an LED light distribution structure with the center d on the center line b and the ring-shaped wiring line c located outside the center line b according to an example of the present disclosure.
Figure 3:
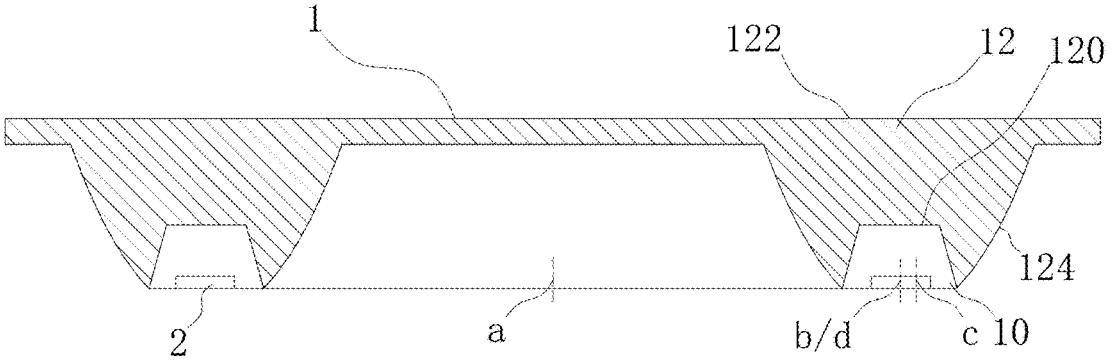
FIG. 3 is a cross-sectional view of FIG. 2.

In order to make the purpose, technical solutions, and advantages of the present disclosure clearer, the technical solutions of the present disclosure will be described clearly and completely in conjunction with examples of the present disclosure and the corresponding drawings. Apparently, the described examples are only a part of the examples of the present disclosure, rather than all the examples. Based on the examples in this disclosure, all other examples obtained by those of ordinary skill in the art without creative work shall fall within the protection scope of this disclosure.

Numerals and references in this disclosure may include: 1—Ring-shaped light distribution element, 10—Light source cavity, 12—Light distribution part, 120—Light incident surface; 122—Light emitting surface, 124—Total reflection surface, 2—LED chip, 20—LED, 22—Chip substrate;

a—Ring center, b—Center line, c—Ring-shaped wiring line, d—Center, e—Horizontal axis, f—Vertical axis.

With advancement of technology, light-emitting elements of modern lamps have gradually phased out filaments and incandescent lamps, while light-emitting diodes (LEDs) are generally used as light-emitting elements. In order to facilitate assembly of lamp manufacturers, LED manufacturers sometimes set one LED or several LEDs on a small chip substrate to form an LED chip, so that the lamp manufacturers only need to attach the LED chip to a light source board of a lamp to connect the LED to the circuit.

Since the LED emits light in a spherical shape, the angle of the emitted light is fixed, and the lighting effect is simple. In order to make the lamp present lighting effects such as desired lighting angle and degree of light concentration, sometimes, a light distribution element is usually installed outside the LED to distribute light of the LED. Early light distribution element is sometimes a single light distribution element, that is, each LED or LED chip has an independent revolving light distribution element, and the LED chip is located in the middle position of the revolving light distribution element to make the light spot circular. When it is necessary to adjust the light emitting angle, there may be two methods, one of which is to directly change light distribution configuration of the light distribution element, which is extremely costly. In order to save costs, the light emitting angle can be adjusted without changing the light distribution element by changing a distance between the LED chip and the light distribution element (Z-axis distance).

At a later stage, a ring-shaped light distribution element was gradually developed. One light distribution element can simultaneously distribute light for multiple LED chips arranged in a ring shape, and can also form a circular light spot. Considering that light of each LED chip can be uniformly distributed by the ring-shaped light distribution element, the LED chip is usually arranged on a center line of a light source cavity of the ring-shaped light distribution element. For such a ring-shaped light distribution element, when it is desired to adjust the light emitting angle without changing the light distribution configuration of the light distribution element, currently the above-mentioned method of changing the distance between the LED chip and the light distribution element (Z-axis distance) is also commonly used.

However, although the of adjusting angle does not need to change the light distribution configuration of the light distribution element, it requires additional structural members between the light source board and the light distribution element to adjust the Z-axis distance, and the structure is still relatively complicated.

Examples of the present disclosure disclose an LED light distribution structure, as shown in FIG. 1 to FIG. 15, the LED light distribution structure includes a ring-shaped light distribution element 1 and a plurality of LED chips 2. The ring-shaped light distribution element 1 is provided with a light source cavity 10 in a ring shape, and the light source cavity 10 has a ring center a and a center line b surrounding the ring center in a ring shape. The ring-shaped light distribution element 1 further has a light distribution part 12, the light distribution part 12 is arranged around the light source cavity 10, and an interface between the light distribution part 12 and the light source cavity 10 is a light incident surface 120 of the light distribution part 12. After light enters the light distribution part 12 from the light incident surface 120, the light path can be adjusted by means of refraction or reflection, and the light finally exits from the light emitting surface 122 that is substantially opposite to the light incident surface 120. Generally, a radial cross section of the light source cavity 10 and the light distribution part 12 is an axisymmetric structure, and the axis intersects perpendicularly with the center line b. The ring-shaped light distribution element in this example may be a ring-shaped refractive lens, or may also be a ring-shaped total reflection lens. A difference between the two types of lenses mainly lies in the structure of the light distribution part 12. The light distribution part 12 of the ring-shaped refractive lens distributes light according to the principle of light refraction of a concave lens or a convex lens, while the light distribution part 12 of the ring-shaped total reflection lens further adds a total reflection surface 124 based on the refraction, so as to present a light distribution effect different from that of the ring-shaped refractive lens.

A plurality of LED chips 2 are arranged in a ring shape in the light source cavity 10, the LED chip 2 includes an LED 20 and a chip substrate 22; and the LED 20 is arranged on the chip substrate 22. The LEDs 20 on all the LED chips 2 are uniformly arranged along a ring-shaped wiring line c; the ring-shaped wiring line c is in a concentric ring with a center line b. Depending on a required light emitting angle, the ring-shaped wiring line c may be located inside the center line b (referring to FIGS. 2, 3, 5, 6, 11 and 12), or it may be located outside the center line (referring to FIGS. 1, 7 and 8). When the light emitting angle needs to be increased, the ring-shaped wiring line c will be located inside the center line b; in this case, the light distribution part 12 will have a polarization effect on the light of the LED 20, and the light emitted by the LED 20 will be more emitted by the light distribution part 12 to a side away from the ring center a, so the overall LED light distribution structure may have a larger light emitting angle. Conversely, when the light emitting angle needs to be reduced, the ring-shaped wiring line c will be located outside the center line b; in this case, the light emitted by the LED 20 will be more emitted by the light distribution part 12 to the side facing the ring center a, so the LED light distribution structure as a whole may have a smaller light emitting angle.

Moreover, although a single LED 20 will be in a situation of polarized light distribution after the above-described adjustment, since the LEDs 20 are all located on a same ring-shaped wiring line c, polarized light distribution effect of each LED 20 may be kept consistent; and with respect to the overall light emitting effect of all the LEDs 20, the overall circular light spot may still be guaranteed.

With respect to the light source module that implements the above-described LED light distribution structure, the LED chips 2 of the above-described LED light distribution structure may be directly arranged on a light source board (not shown), and the ring-shaped light distribution element 1 may cover the light source board, so as to implement the corresponding light distribution effect, without additionally providing other structural members in the module structure. Therefore, compared with the adjustment structure in the related art, the LED light distribution structure provided by this example may more simplify the structure of the light source module.

In production practice, the chip substrate 22 usually has a center d; the center d may refer to a geometric center of the chip substrate 22; when the chip substrate 22 has a circular, square, or other similar shape, it has a geometric center. In addition, the center may also refer to the center of various forms such as a size center or a vertical center of the chip substrate. The center d is usually arranged at the position of the center line b of the light source cavity 10 in the related art.

In this example, depending on the model of the LED chip 2, the LED 20 may be located at the above-described center d, or may not be located at the above-described center d. For LED chips 2 of different structures, different structural forms may be adopted.

Figure 4:
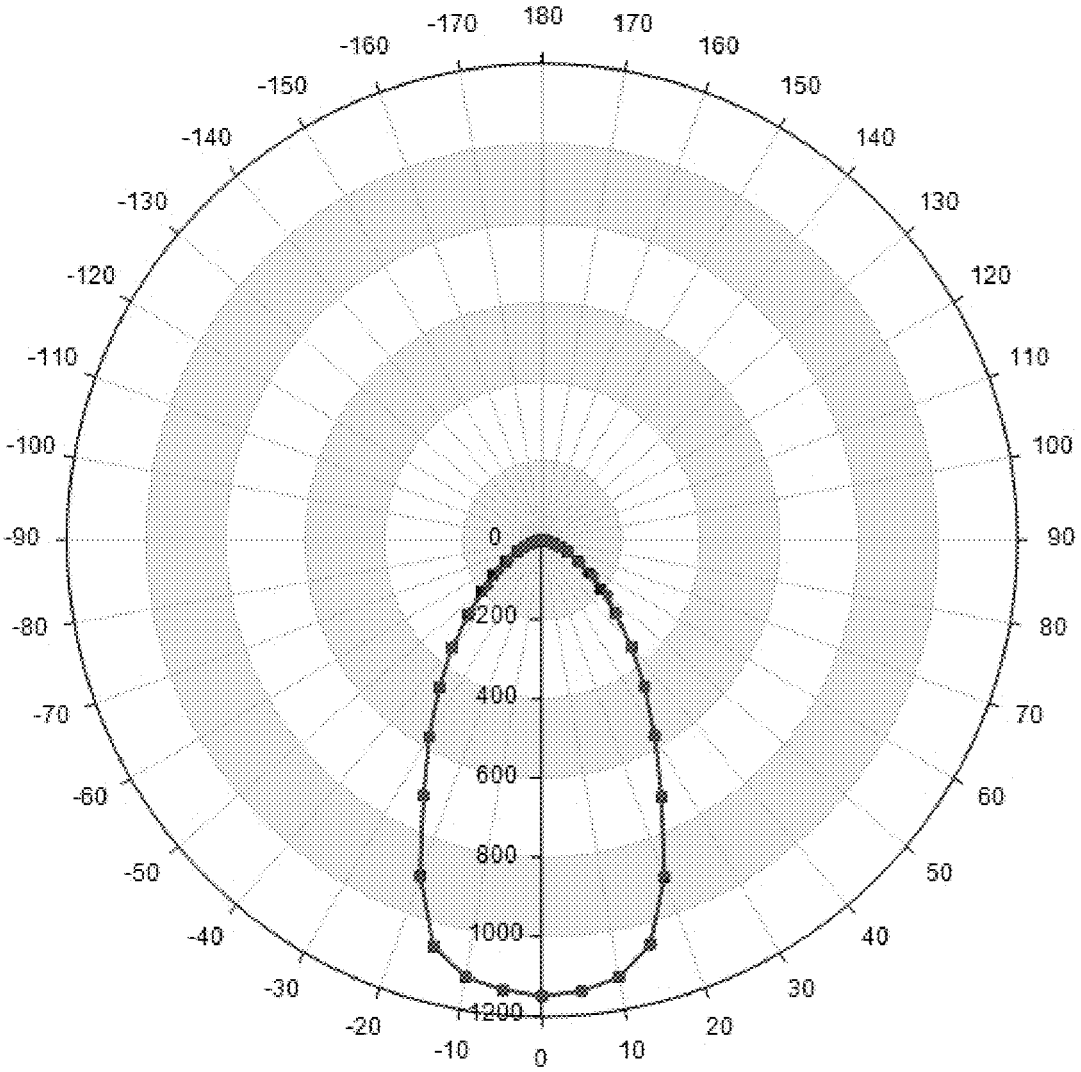
FIG. 4 is a light distribution curve diagram of the LED light distribution structure provided in FIG. 2.
Figure 5:
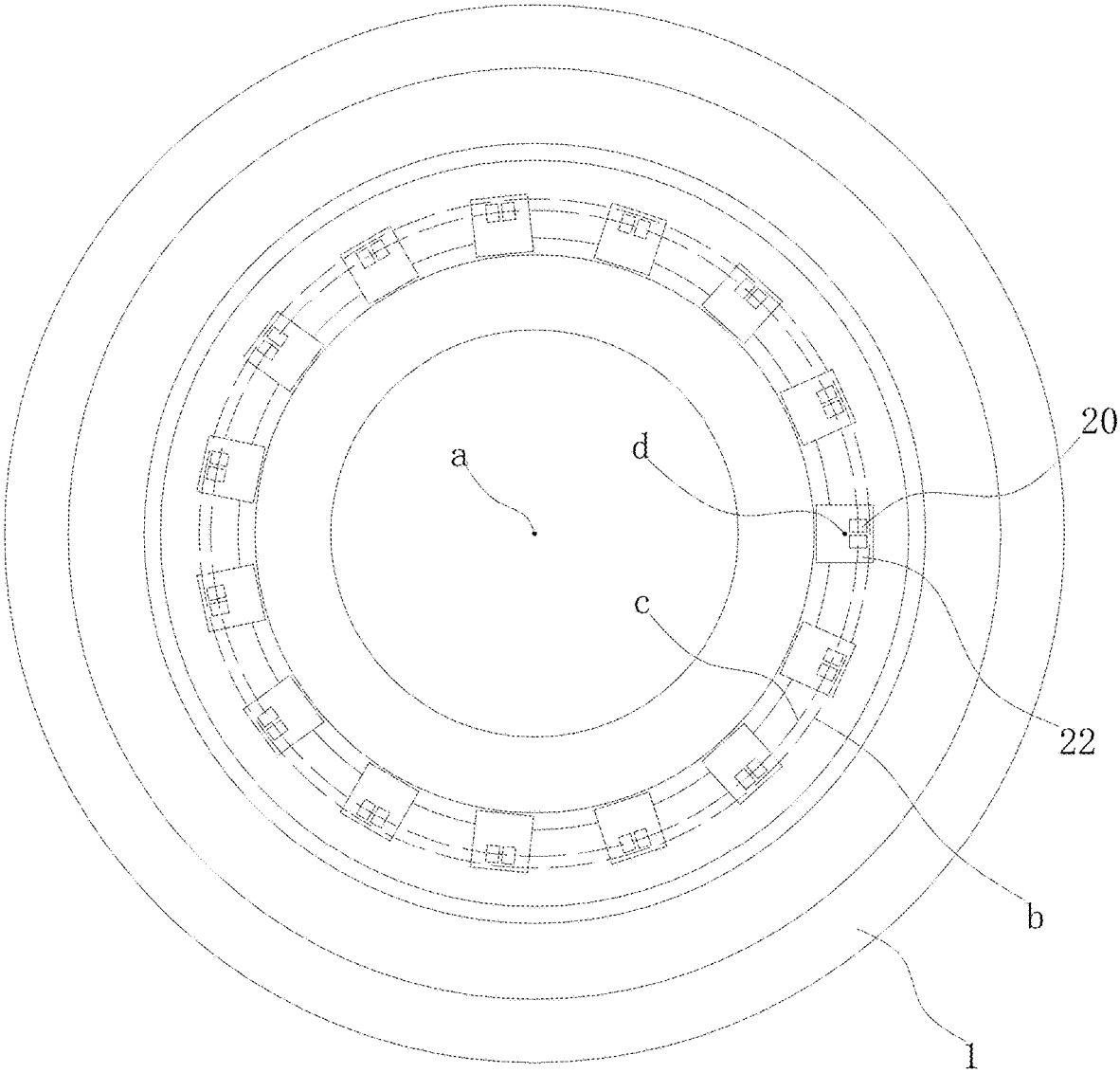
FIG. 5 is a top assembly view of an LED light distribution structure with both the center d and the ring-shaped wiring line c located inside the center line b according to an example of the present disclosure.
Figure 6:
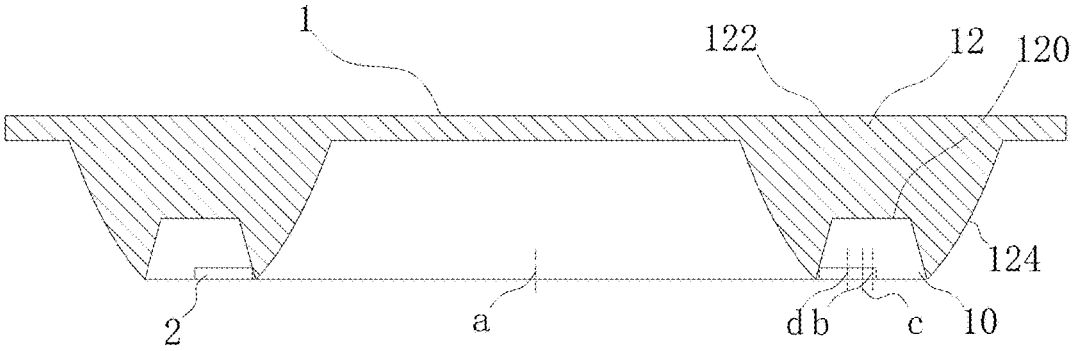
FIG. 6 is a cross-sectional view of FIG. 5.
Figure 13:
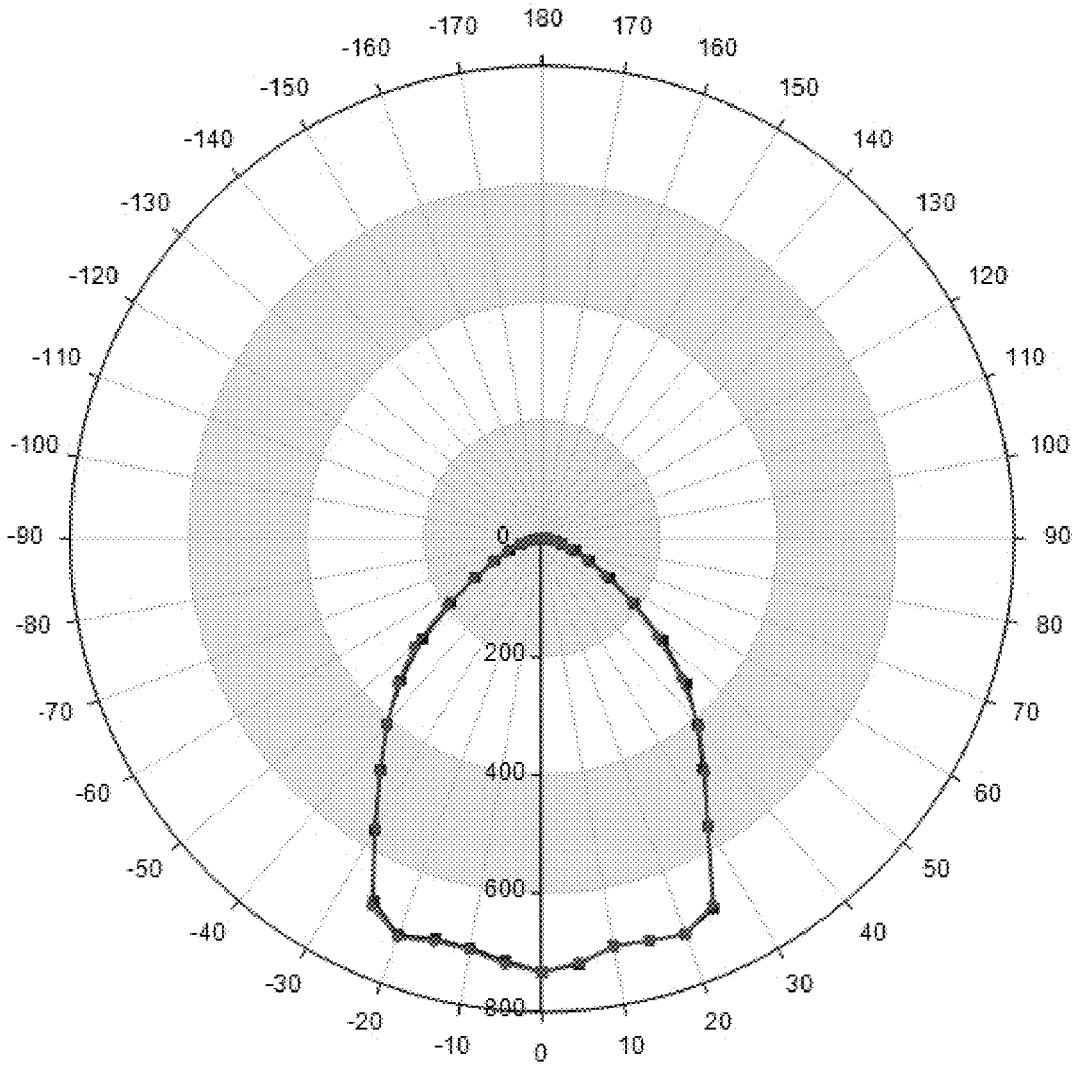
FIG. 13 is a light distribution curve diagram of the LED light distribution structure provided in FIG. 11.

As shown in FIGS. 1, 2, 3, 11 and 12, when the LED 20 is not located at the center d of the chip substrate 22, the center d of the chip substrate 22 may be located on the center line b. In this case, the LED 20 is located at an off-center position. By rotating the LED chip 2 with the center d as an axis, the LED 20 will rotate around the center d, thereby implementing adjustment of the position of the LED 20. In this case, it is only necessary to control all the LEDs to be located in a same ring-shaped wiring line c to implement adjustment of the light emitting angle. Referring to FIG. 4 and FIG. 13, taking Qingzhi 60° floodlight as an example and choosing OSRAM3030 as LED, by rotating the LED chip 2 with the center d as the axis, a beam angle may be adjusted within a range of 60° (FIG. 4) to 86° (FIG. 13).

Figure 7:
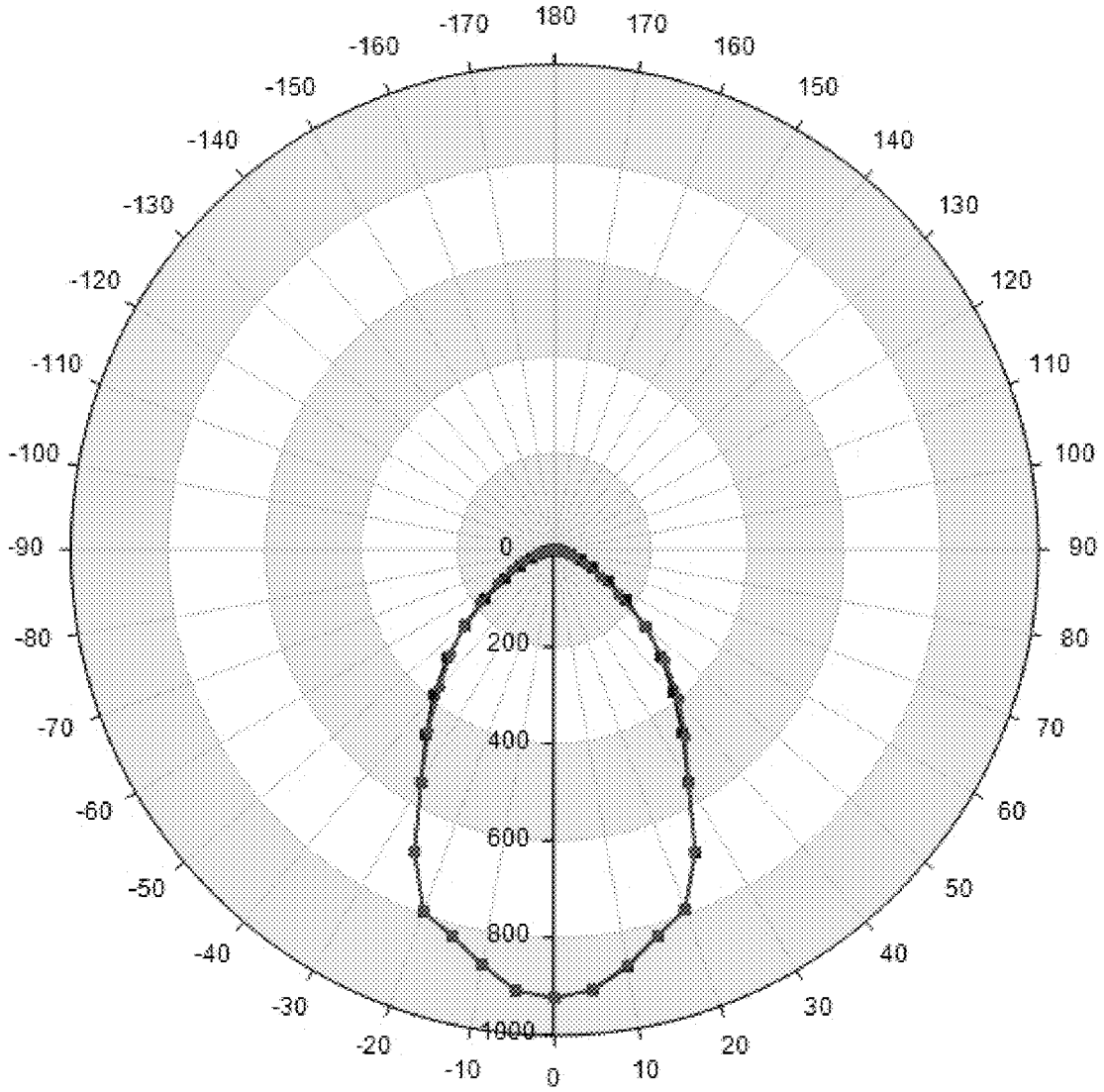
FIG. 7 is a light distribution curve diagram of the LED light distribution structure provided in FIG. 5.
Figure 8:
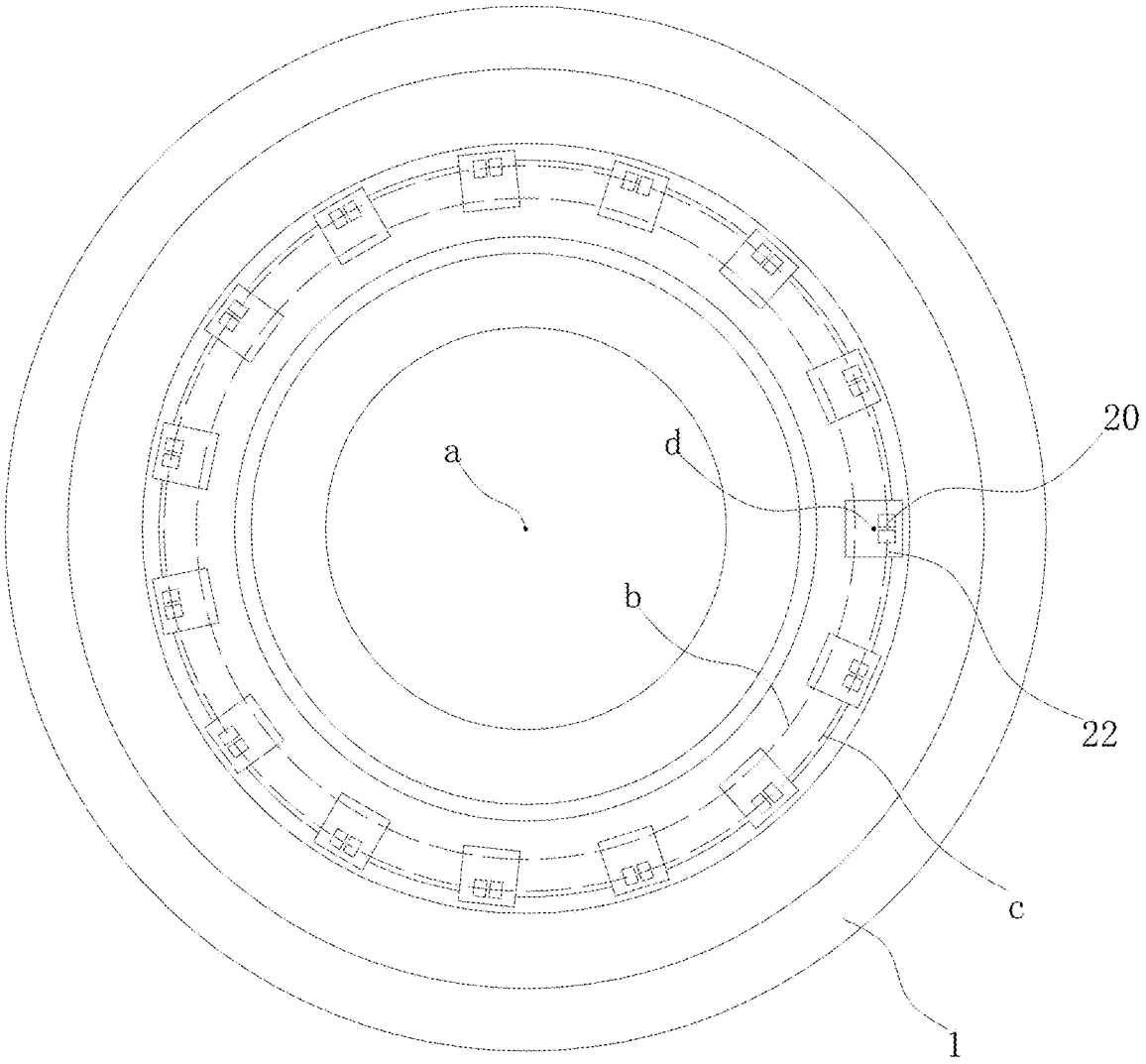
FIG. 8 is a top assembly view of an LED light distribution structure with both the center d and the ring-shaped wiring line c located outside the center line b according to an example of the present disclosure.
Figure 9:
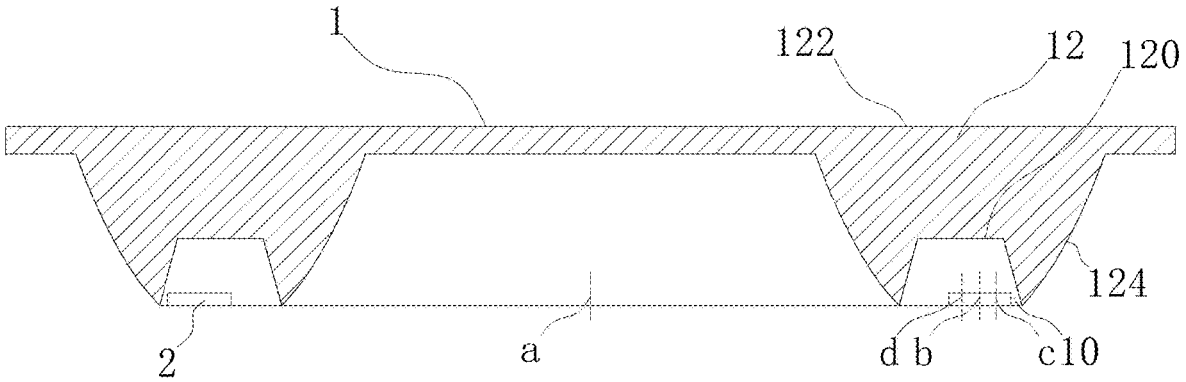
FIG. 9 is a cross-sectional view of FIG. 8.
Figure 10:
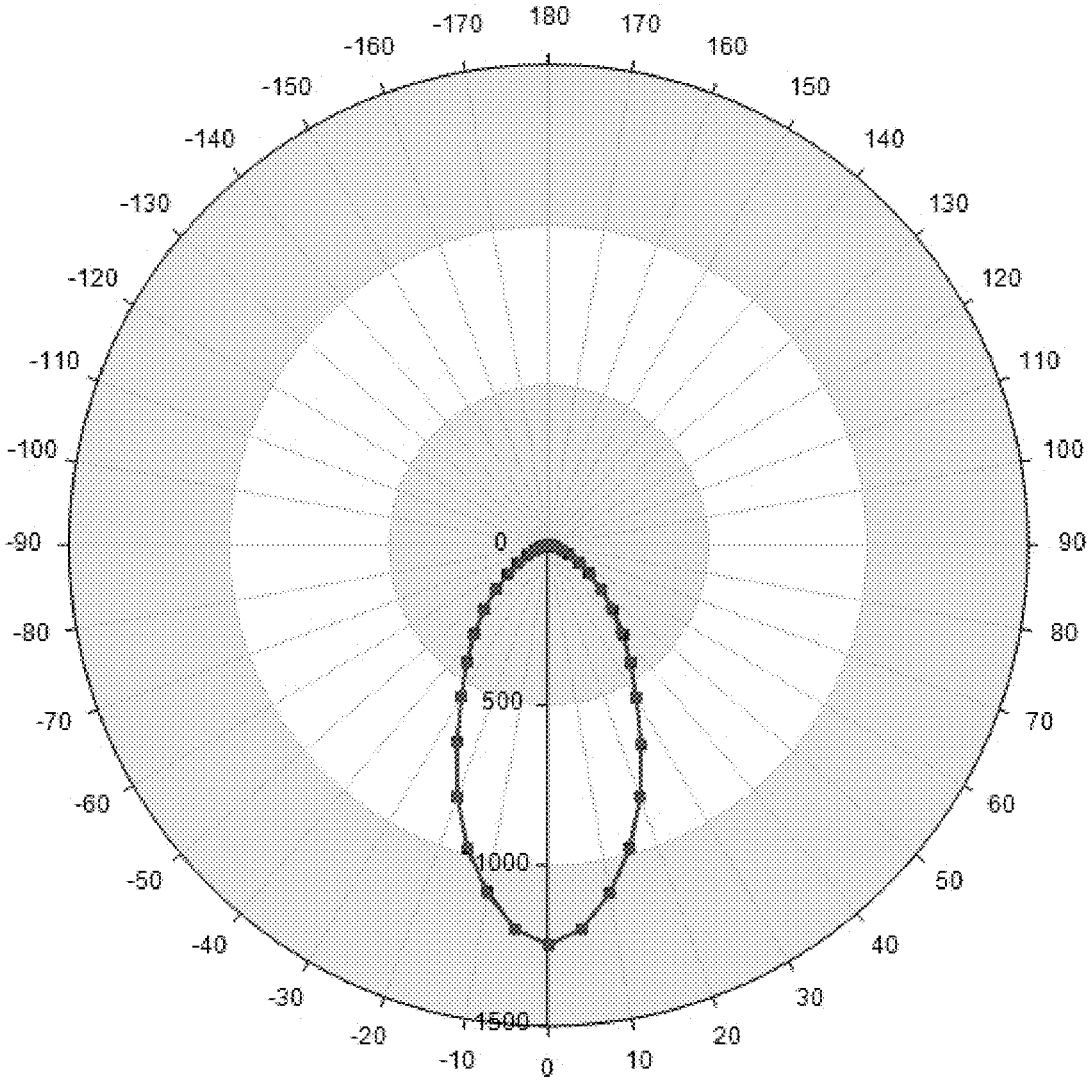
FIG. 10 is a light distribution curve diagram of the LED light distribution structure provided in FIG. 8.
Figure 11:
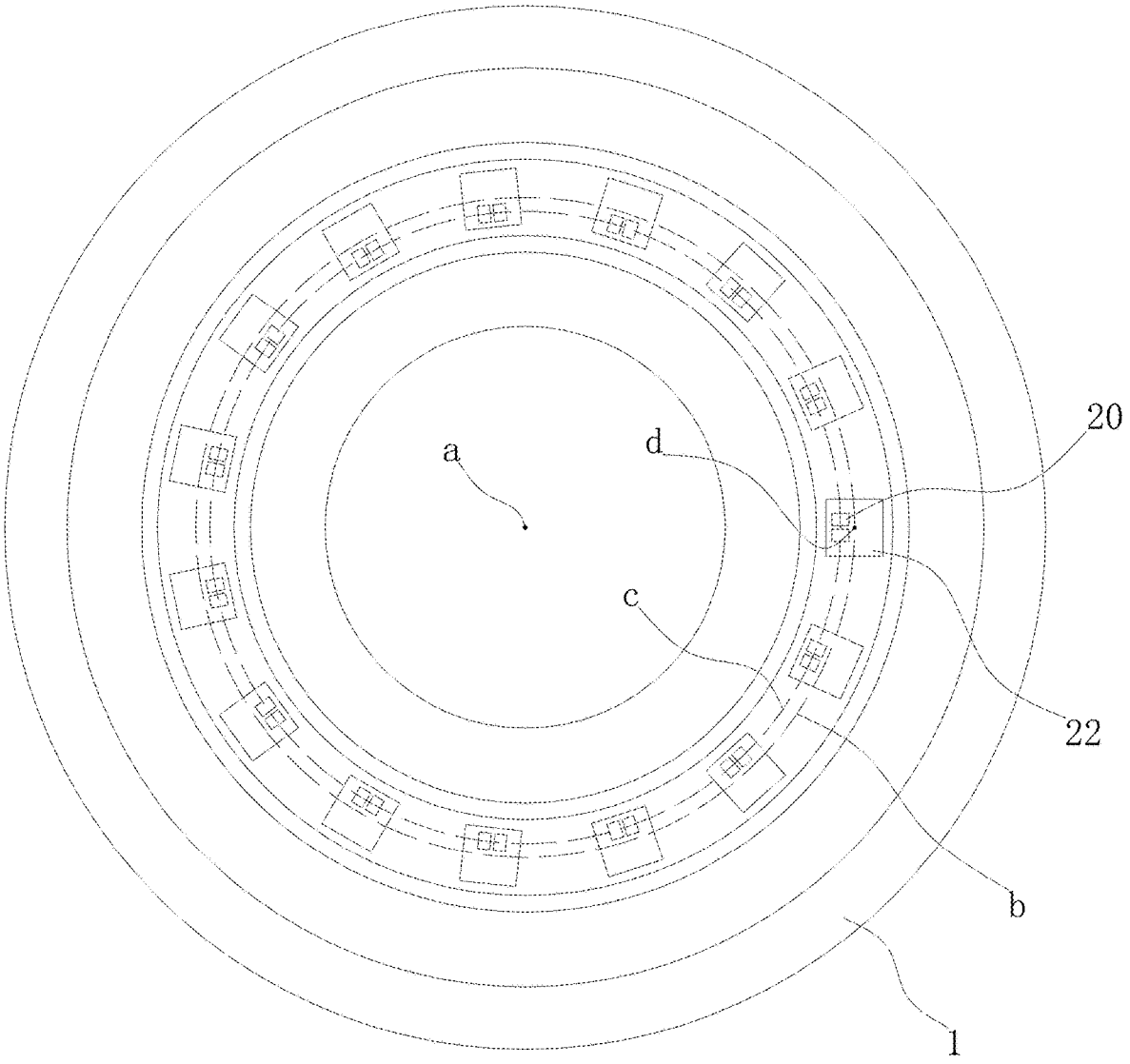
FIG. 11 is a top assembly view of an LED light distribution structure with the center d on the center line b and the ring-shaped wiring line c located inside the center line b according to an example of the present disclosure.
Figure 12:
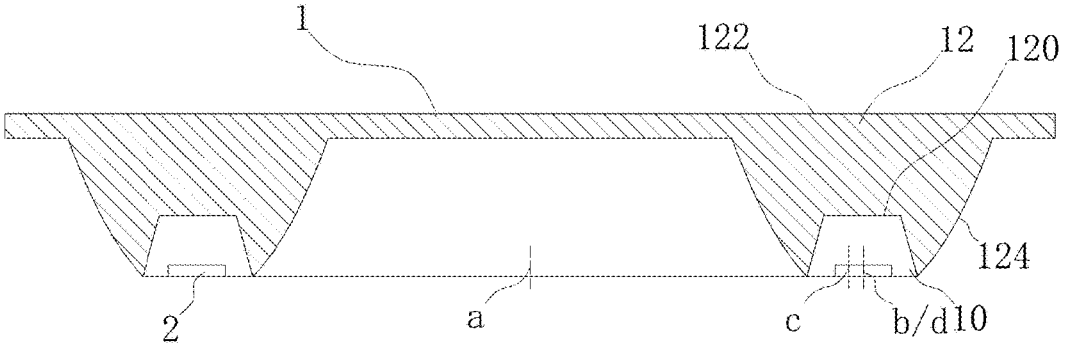
FIG. 12 is a cross-sectional view of FIG. 11.

When the LED 20 is located at the center d of the chip substrate 22, the position of the entire LED chip 2 may be directly adjusted, so that the center d of the chip substrate 22 is located inside or outside the center line b, while keeping the original posture of the LED chip 2 unchanged, so that the position of the LED 20 may still be adjusted. Moreover, such an adjustment mode may also be applied to a case where the LED 20 is not located at the center d of the chip substrate 22 (referring to FIGS. 2 to 10). Referring to FIGS. 4, 7 and 10, also taking Qingzhi 60° floodlight as an example and choosing OSRAM3030 as LED, in a posture that the LEDs 20 on the LED chip 2 are all located on a side of the chip substrate 22 away from the center d, by adjusting the position of the LED chip 2, the beam angle may be adjusted within a range of 54° (FIG. 10) to 70° (FIG. 7).

Through the above-described two adjustment modes, the beam angle may be adjusted within the range of 54° to 86°. In some other examples, the above-described two adjustment modes may also be applied to the LED chip 2 whose LED 20 is not located at the center d of the chip substrate 22 at the same time, that is, on the one hand, changing the position of the center of the chip substrate 22, so that the position of the center is located inside or outside the center line b, and on the other hand, rotating the LED chip 2 with the center d as the axis to further change the position of the LED 20. In this way, a larger angle adjustment range may be obtained.

In order to coordinate position adjustment or rotation of the LED chip 2, it is usually necessary to accordingly adjust a bonding pad corresponding to the LED chip 2 on the light source board, to adjust the position or posture of the bonding pad to be consistent with the LED chip 2. In some cases, due to limitation of circuit arrangement on the light source board, the light source board may not be able to adopt a single adjustment mode to adjust the bonding pad; however, the solution of applying the two adjustment modes at the same time gives the light source board more wiring options, which is favorable for reasonable wiring of the light source board, and reducing difficulty of wiring and processing of the light source board.

Figure 15:
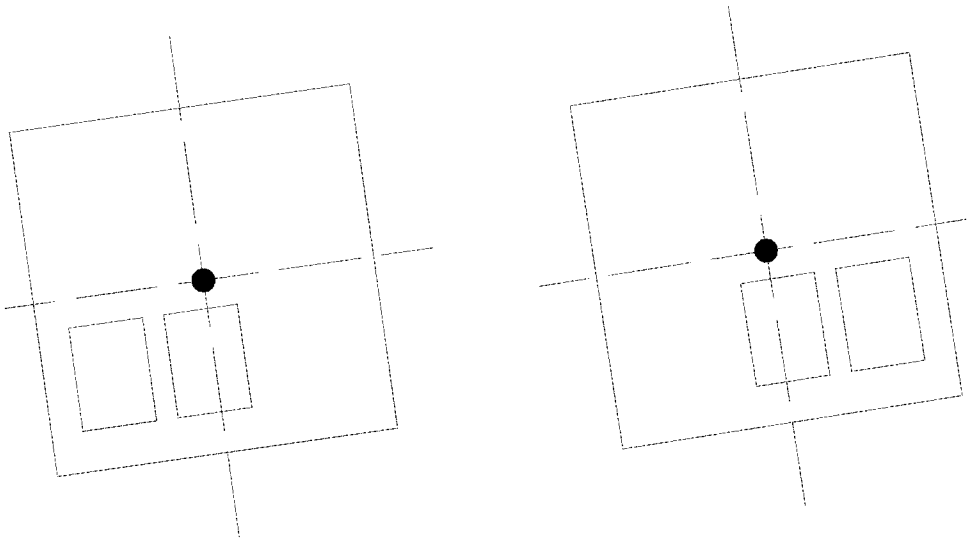
FIG. 15 shows two postures of the LED chip provided by an example of the present disclosure.

With respect to the adjustment mode of rotating the LED chip 2 with the center d as the axis, due to difference in rotation directions, in most cases, the LED 20 may either be rotated clockwise until it is located in the ring-shaped wiring line c, or may be rotated counterclockwise until it is located in the ring-shaped wiring line c, so as to form two different postures (referring to FIG. 15). Although distances between the LED 20 and the ring center a or the center line b are the same in these two postures, there will still be some shifts in the position of the light spot formed by the LED 20 due to position difference in the circumferential direction of the ring. These shifts may cause uneven brightness distribution of the overall light spot. Therefore, in order to make brightness distribution of the light spot relatively uniform, in this example, it is preferable that the postures of all the LED chips 2 are kept consistent in the circumferential direction relative to the ring center a. In this way, while changing the position of the LED 20 relative to the ring center a or the center line b, all the LEDs 20 may move a same distance along the circumferential direction in a same direction to ensure that their spacing does not change, thereby ensuring uniform brightness distribution.

Figure 14:
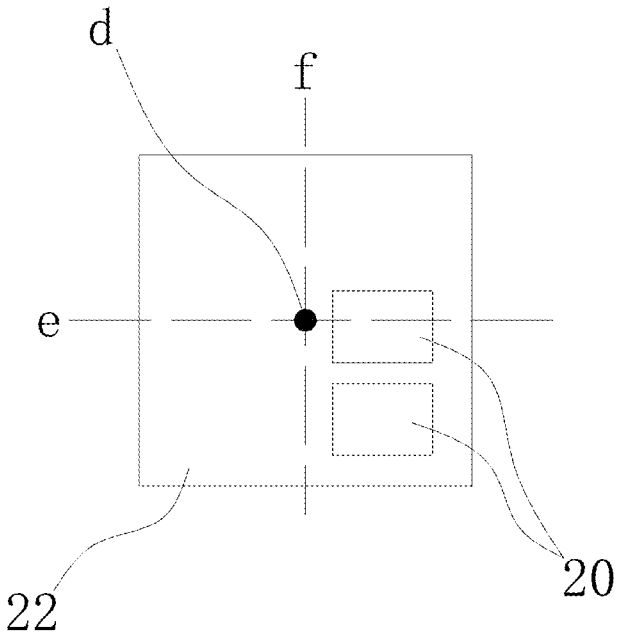
FIG. 14 is a structural view of an LED chip including multiple LEDs provided by an example of the present disclosure.

With respect to the adjustment mode of this example, it is more applicable to the LED chip 2 with a structure below. As shown in FIG. 14, the chip substrate 22 of the LED chip 2 has a horizontal axis e and a vertical axis f that pass through the center d and are perpendicular to each other; the horizontal axis e and the vertical axis f divide the chip substrate 22 into four quadrants; and the number of LED 20 included in the LED chip 2 may be only one, or a plurality of LEDs may be included at the same time. No matter which solution is adopted, with respect to the LED(s) 20 as a whole, at least most of the LEDs 20 are located in one of the quadrants, and there may be a small part of the LEDs 20 located in adjacent or even opposite other quadrants. Such kind of LED chip 2 may be based on the horizontal axis e and the vertical axis f, which is more convenient for technicians to adjust the position of the LED 20. As shown in FIG. 1, in some examples, both the horizontal axis e and the vertical axis f may not be perpendicular to a connection line from the ring center a to the center d, but at a certain angle (referring to FIG. 1).

When the LED chip 2 includes a plurality of LEDs 20, these LEDs 20 may be located in a same ring-shaped wiring line c, but it is more likely that LEDs 20 located in a same position are located in a same ring-shaped wiring line c, and LEDs 20 located in different positions are located in different ring-shaped wiring lines c, thereby forming a plurality of ring-shaped wiring lines c1 and c2.

The light source module provided by this example may be arranged on the lamp body while it is arranged inside the lamp. In addition, according to different light efficiency requirements, a plurality of light source modules may be arranged in a planar array or in a concentric ring form in the same lamp at the same time. The light source boards of these light source modules may be independent of each other or integrated into a whole.

In summary, the LED light distribution structure, the light source module, and the lamp provided by the examples of the present disclosure may greatly simplify the structure.

Examples of the present disclosure provides an LED light distribution structure, a light source module and a lamp.

On the one hand, the examples of the present disclosure provide an LED light distribution structure, which comprises a ring-shaped light distribution element and a plurality of LED chips;

the ring-shaped light distribution element is provided with a light source cavity in a ring shape, and the light source cavity has a ring center and a center line surrounding the ring center in a ring shape;

the plurality of LED chips are arranged in a ring shape in the light source cavity, each of the LED chips comprises an LED and a chip substrate, and the LED is on the chip substrate; and LEDs on all the LED chips are uniformly arranged along a ring-shaped wiring line, the ring-shaped wiring line is in a concentric ring with the center line, and the ring-shaped wiring line is located inside or outside of the center line.

Optionally, in the above LED light distribution structure, the chip substrate has a center, and the LED is at the center or not at the center.

Optionally, in the above LED light distribution structure, the LED is not at the center, and the center of the chip substrate is on the center line.

Optionally, in the above LED light distribution structure, the center of the chip substrate is inside or outside the center line.

Optionally, in the above LED light distribution structure, the chip substrate has a horizontal axis and a vertical axis that pass through the center and are perpendicular to each other, the horizontal axis and the vertical axis divide the chip substrate into four quadrants, and at least most of the LEDs are located in one of the quadrants.

Optionally, in the above LED light distribution structure, the horizontal axis and the vertical axis are not perpendicular to a connection line from the ring center to the center.

Optionally, in the above LED light distribution structure, all the LED chips have the same posture relative to the ring center in a circumferential direction.

Optionally, in the above LED light distribution structure, the LED chip comprises a plurality of LEDs, and the plurality of LEDs are all on the chip substrate.

Optionally, in the above LED light distribution structure, the ring-shaped light distribution element is a ring-shaped refractive lens or a ring-shaped total reflection lens.

On the second hand, the examples of the present disclosure provide a light source module, which comprises a light source board and the LED light distribution structure;

the LED chips are arranged on the light source board, and the ring-shaped light distribution element covers on the light source board.

On the third hand, the examples of the present disclosure provide a lamp, which comprises a lamp body and at least one light source module, the light source module is arranged on the lamp body.

The above at least one technical solution adopted in the examples of the present disclosure can achieve the following beneficial effects.

The LED light distribution structure, the light source module, and the lamp provided by the examples of the present disclosure can adjust the light emitting angle while maintaining the circular spot by changing the position of the LED relative to the center line of the light source cavity. This method of adjusting the light emitting angle does not require additional structural members between the light source board and the light distribution element, so the structure can be greatly simplified.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The above examples of the present disclosure are only focused on describing differences between the respective examples, different optimized features of the respective examples may be combined to form a different example as long as there is no conflict, and no details will be repeated here in consideration of text conciseness.

The above are only examples of the present disclosure, and not intended to limit the present disclosure. For those skilled in the art, various changes and modifications may be made to the present disclosure. Any modifications, equivalent alternations and improvements without departing from the spirit and principle of the present disclosure shall be included within the protection scope of the present disclosure.

The invention claimed is:

1. An LED light distribution structure, comprising: a ring-shaped light distribution element and a plurality of LED chips; wherein:

the ring-shaped light distribution element is provided with a light source cavity in a ring shape, and the light source cavity has a ring center and a center line surrounding the ring center in a ring shape;

the plurality of LED chips are arranged in a ring shape in the light source cavity, each of the LED chips comprises an LED and a chip substrate, and the LED is on the chip substrate; and LEDs on all the LED chips are uniformly arranged along a ring-shaped wiring line, the ring-shaped wiring line is in a concentric ring with the center line, and the ring-shaped wiring line is located inside or outside of the center line, wherein the chip substrate has a center, the LED is at the center or not at the center, and the center of the chip substrate is inside or outside the center line.

2. The LED light distribution structure according to claim 1, wherein the LED is not at the center, and the center of the chip substrate is on the center line.

3. The LED light distribution structure according to claim 2, wherein the chip substrate has a horizontal axis and a vertical axis that pass through the center and are perpendicular to each other, the horizontal axis and the vertical axis divide the chip substrate into four quadrants, and at least most of the LEDs are located in one of the quadrants.

4. The LED light distribution structure according to claim 3, wherein the horizontal axis and the vertical axis are not perpendicular to a connection line from the ring center to the center.

5. The LED light distribution structure according to claim 1, wherein all the LED chips have the same posture relative to the ring center in a circumferential direction.

6. The LED light distribution structure according to claim 1, wherein the LED chip comprises a plurality of LEDs, and the plurality of LEDs are all on the chip substrate.

7. The LED light distribution structure according to claim 1, wherein the ring-shaped light distribution element is a ring-shaped refractive lens or a ring-shaped total reflection lens.

8. A light source module, comprising a light source board and an LED light distribution structure; wherein:

the LED light distribution structure comprises a ring-shaped light distribution element and a plurality of LED chips;

the ring-shaped light distribution element is provided with a light source cavity in a ring shape, and the light source cavity has a ring center and a center line surrounding the ring center in a ring shape;

the plurality of LED chips are arranged in a ring shape in the light source cavity, each of the LED chips comprises an LED and a chip substrate, and the LED is on the chip substrate;

LEDs on all the LED chips are uniformly arranged along a ring-shaped wiring line, the ring-shaped wiring line is in a concentric ring with the center line, and the ring-shaped wiring line is located inside or outside of the center line; and the LED chips are arranged on the light source board, and the ring-shaped light distribution element covers on the light source board, wherein the chip substrate has a center, the LED is at the center or not at the center, and the center of the chip substrate is inside or outside the center line.

9. A lamp, comprising a lamp body and at least one light source module according to claim 8, wherein the light source module is arranged on the lamp body.

10. An LED light distribution structure, comprising:

a ring-shaped light distribution element provided with a light source cavity in a ring shape, wherein the light source cavity comprises a ring center and a center line surrounding the ring center in a ring shape; and a plurality of LED chips arranged in a ring shape in the light source cavity, at least one of the LED chips comprises an LED and a chip substrate, and the LED is on the chip substrate, wherein the chip substrate has a center, the LED is at the center or not at the center, and the center of the chip substrate is inside or outside the center line.

11. The LED light distribution structure according to claim 10, wherein the LED is not at the center, and the center of the chip substrate is on the center line.

12. The LED light distribution structure according to claim 11, wherein the chip substrate has a horizontal axis and a vertical axis that pass through the center and are perpendicular to each other, the horizontal axis and the vertical axis divide the chip substrate into four quadrants, and at least most of the LEDs are located in one of the quadrants.

13. The LED light distribution structure according to claim 12, wherein the horizontal axis and the vertical axis are not perpendicular to a connection line from the ring center to the center.

14. The LED light distribution structure according to claim 10, wherein all the LED chips have the same posture relative to the ring center in a circumferential direction.

15. The LED light distribution structure according to claim 10, wherein the at least one of the LED chips comprises a plurality of LEDs, and the plurality of LEDs are all on the chip substrate.

16. The LED light distribution structure according to claim 3, wherein the LED chip comprises a plurality of LEDs, and the plurality of LEDs are all on the chip substrate.

17. The LED light distribution structure according to claim 5, wherein the LED chip comprises a plurality of LEDs, and the plurality of LEDs are all on the chip substrate.

18. The LED light distribution structure according to claim 10, wherein the ring-shaped light distribution element is a ring-shaped refractive lens or a ring-shaped total reflection lens.

19. The LED light distribution structure according to claim 3, wherein the ring-shaped light distribution element is a ring-shaped refractive lens.

20. The LED light distribution structure according to claim 3, wherein the ring-shaped light distribution element is a ring-shaped total reflection lens.

* * * * *